US011834927B2

(12) United States Patent
Ferreira Da Silva et al.

(10) Patent No.: US 11,834,927 B2
(45) Date of Patent: Dec. 5, 2023

(54) METHOD FOR PREVENTING SALINE SCALE IN LOW-ACTIVITY, AQUEOUS-PHASE RESERVOIR WELLS AND ITS USE

(71) Applicant: Petróleo Brasileiro S.A.—Petrobras, Rio de Janeiro (BR)

(72) Inventors: Mario Germino Ferreira Da Silva, Rio de Janeiro (BR); Francisca Ferreira Do Rosario, Rio de Janeiro (BR); Tiago Cavalcante Freitas, Rio de Janeiro (BR); Fernando Antonio Moreira Da Silva, Rio de Janeiro (BR); Roberto Motto Gomes, Rio de Janeiro (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 0 days.

(21) Appl. No.: 17/483,877

(22) Filed: Sep. 24, 2021

(65) Prior Publication Data

US 2022/0136369 A1 May 5, 2022

(30) Foreign Application Priority Data

Sep. 25, 2020 (BR) ..... 10 2020 019468 2

(51) Int. Cl.
*E21B 37/06* (2006.01)
*E21B 41/02* (2006.01)

(52) U.S. Cl.
CPC ..... *E21B 37/06* (2013.01); *E21B 41/02* (2013.01)

(58) Field of Classification Search
CPC ..... E21B 37/06; E21B 41/02
(Continued)

(56) References Cited

U.S. PATENT DOCUMENTS 6,663,778 B1 * 12/2003 Bader ..... B01D 61/147 210/729
8,919,445 B2 * 12/2014 Fowler ..... E21B 43/01 166/61

(Continued)

FOREIGN PATENT DOCUMENTS

| | | | |
|---|---|---|---|
| BR | PI08171882 | A2 | 4/2009 |
| BR | PI05135869 | B1 | 6/2016 |
| BR | 1020150138334 | A2 | 3/2017 |

OTHER PUBLICATIONS

Queiroz, A.C.C.; Silva, S.J.P., "The influence of scale squeeze acid stimulation treatments (injection of fluids into wells for the chemical treatment of scale) on the productivity index of producing wells," Final Project (Bachelor's Degree in Petroleum Engineering), 98f., Universidade Federal Fluminense, Niter6i, RJ, 2017.

(Continued)

*Primary Examiner* — William D Hutton, Jr.
*Assistant Examiner* — Ashish K Varma
(74) *Attorney, Agent, or Firm* — Mintz Levin Cohn Ferris Glovsky and Popeo, P.C.

(57) ABSTRACT

This invention contains a method focused on increasing the water saturation of the reservoir by injecting industrial water into the well via SPU, thus diluting the concentration of salts, such as halite (sodium chloride). When the oil passes through the gas lift mandrel, this dilution will allow a part of the BSW water to evaporate, however, the amount of water that will remain in the oil will be sufficient to keep the salts in solution, thus scale formation will not occur and therefore no loss of production will occur. One of the focus areas of the method of this invention are high-temperature and low-BSW production reservoir wells. The solution of this invention minimizes the frequency of well treatments, avoiding loss of production due to well stoppage. The technical advantages of the method are increased reliability (Continued)

for SPU, increased NPV of operations and increased safety due to the reduction of operations with participation of the stimulation vessel.

4 Claims, 2 Drawing Sheets

(58) Field of Classification Search
USPC ..... 166/304
See application file for complete search history.

(56) References Cited

U.S. PATENT DOCUMENTS

| | | | | |
|---|---|---|---|---|
| 10,995,027 | B1 * | 5/2021 | Bader | B01D 71/32 |
| 2014/0318788 | A1 * | 10/2014 | Agrawal | C09K 8/52 166/300 |

OTHER PUBLICATIONS

Ariza, S.F.C., "Application Studies of a New Parameter for Performance Analysis of Oil Production Systems," Master's Dissertation, University of Campinas, SP, 2011.

Costa, A.K.M., "Analysis on production water for disposal and reinjection purposes," Final Project (Bachelor's Degree in Petroleum Engineering), 70f., Fluminense Federal University, Niter6i, RJ, 2017.

* cited by examiner

METHOD FOR PREVENTING SALINE SCALE IN LOW-ACTIVITY, AQUEOUS-PHASE RESERVOIR WELLS AND ITS USE

CROSS-REFERENCE TO RELATED APPLICATIONS

This application claims priority to Brazilian Application No. 10 2020 019468 2, filed on Sep. 25, 2020, and entitled "METHOD FOR PREVENTING SALINE SCALE IN LOW-ACTIVITY, AQUEOUS-PHASE RESERVOIR WELLS AND ITS USE," the disclosure of which is incorporated herein by reference in its entirety.

FIELD OF THE INVENTION

This invention contains a method of industrial water injection that incorporates a scale inhibitor in the reservoir that is used in the field of well-recovery technology, with high temperature and low BSW production that seeks to offset the low water content in the fluid produced to prevent the formation of incrustations.

DESCRIPTION OF THE STATE OF THE ART

Oil reservoirs are permeable, porous or fractured rock formations in subsurfaces that contain fluids, hydrocarbons, gas and water in their interior, which, in order to form in the reservoir rock must have empty spaces in their interior (porosity), and these voids must be interconnected, conferring the characteristic of permeability. Sandstone and limestone are the main types of these rocks.

In addition to hydrocarbons, the pores of a reservoir rock contain water. Therefore, knowing the porous volume is not sufficient for determining the quantities of oil and/or gas the formations contain. For this it is necessary to establish how much fluid is in the porous volume of the rock. Saturation is an estimated percentage that reflects the amount of this porous volume that is occupied by the oil, gas and water. When the reservoir is discovered, it has a certain water saturation, which is called connate water or formation water, which can be highly saline, and there may be the presence of heavy metals in varying percentages.

Production of water is quite common and will depend on the conditions in which it is presented in the porous medium. It can also originate in accumulations of water, called aquifers. Its movement will depend on two factors, the porosity and permeability of the reservoir rock. Produced water can approach 100% as the well reaches the end of its productive life. When oil production is accompanied by high water content, the field is said to be mature, and this content is evaluated by the BS&W (Basic Water and Sediment) test, which also determines the sediment content, whose term is the quotient between the water flow plus the sediment being produced, and the total flow of liquid and sediment.

The water may also contain residual fluids from other processes and chemical products used during the movement, such as demulsifiers, corrosion inhibitors, biocides, detergents, dispersants, etc.

Oil production leads to a reduction in reservoir pressure; the aquifer compensates for this pressure by transferring water to the region where the oil had been located. This invasion is more copious when the "field is mature," due to its low pressure, which is insufficient for a natural lifting of the fluids that are in the reservoir to occur.

In Petroleum Geology, an oil reservoir or production zone is a permeable, porous or fractured rock formation in the subsurface that contains hydrocarbons in the continuous phase, within the same field, whose quantity and quality has economic value that is technologically viable to explore.

For production to take place, it is necessary for another material to fill the porous space occupied by the fluids produced. Production occurs due to two main phenomena: decompression, which causes the fluids in the reservoir to expand, and the porous volume to contract, with the displacement of one fluid for another. The set of factors triggering these effects is called the reservoir drive mechanism. Every reservoir has at least one displacement or production mechanism: gas in solution, gas cap, water inflow, gravitational segregation or fluid expansion. These mechanisms are fundamental for recovering hydrocarbons from the reservoir.

Primary recovery is a function of natural buoyancy mechanisms, gas in solution, water inflow, buoyancy generated by the gas cap, drainage due to gravity, among others. Such mechanisms guarantee a surge for a certain period of time. As production continues, there is a drop in pressure, which then requires the use of an artificial lifting method—usually mechanical pumping. The flow of oil inside the well decreases until mechanical pumping becomes uneconomical. The extent of primary recovery varies widely, averaging up to 20% of the oil originally contained in the reservoir.

Secondary recovery refers to techniques such as water or gas injection, the purpose of which is, in part, to maintain reservoir pressure. These techniques can be used in reservoirs where oil is gravitationally drained to the lower part of the formation. Injected fluids are produced together with the oil. The injection of natural gas, for example, is a common practice in installations without pipelines for its transport. Reinjection, in addition to fulfilling the objective of repressurizing the reservoir, serves as a means of storing natural gas for later use. The technique has limited use, with water injection being the most common method of secondary recovery. The latter provides twice the amount of oil than can be obtained through primary recovery. Nearly 40% of oil production in the United States uses this type of recovery. In any case, after secondary recovery, approximately 70% of the total oil in the reservoir remains lodged in its pores.

Tertiary recovery methods are generally used after secondary recovery, and involve injection of substances normally absent from the reservoir. Tertiary recovery methods are generally used after secondary recovery, and involve injections of substances normally absent from the reservoir. Tertiary recovery methods are the result of exhaustive field and laboratory studies whose objective is the production of oil still in the reservoir, after primary and secondary recovery have been exhausted.

Water injection projects are usually comprised of the following parts: water collection system, which can be wells when water is injected underground, or a set of pumps when surface or sea water is used; injection water treatment system; the water injection system itself, which consists of pumps, lines, and injection wells; and a produced-water treatment and disposal system. In certain cases, some of these parts may be dispensed with.

Water injection is a widely used secondary recovery method; when compared to other methods its operating cost is lower.

The source of the water used for this operation can be obtained in four different ways: 1) groundwater; 2) surface water; 3) sea water; 4) produced water.

After the injection phase, all the injected water is produced together with the oil in the reservoir.

Some reservoirs made up of carbonate rocks, such as some pre-salt wells, have low aqueous phase activity, that is, the wells in these reservoirs produce a low BSW value, some around 1% BSW. Depending on the characteristics of the reservoir rock, this water present in the oil sometimes has dissolved salts, such as halite, which is sodium chloride.

This oil produced with low BSW, from the reservoir through the well, passes through the production string, the wet Christmas tree, subsea lines, and production riser, reaching the topside equipment of the SPU (Stationary Production Unit).

Some wells have an artificial lifting system that injects gas into the production string. This injection is performed by the annular of the well into the production string through the gas lift mandrel. This gas is dehydrated when it comes in contact with the BSW water that is mixed with the oil; part of the water evaporates and the relative concentration of salts increases, thus the salts that were dissolved in the water come out of solution, precipitating inside the production string in the part above the gas lift mandrel. This precipitation forms an incrustation shock inside the string, thus reducing the string's internal diameter. This diameter reduction leads to head loss for oil production, thus reducing the well production flow.

This loss of production causes a reduction in the NPV (Net Present Value) of the field project, which will produce below the project flow rate.

Acidification using stimulation vessels to remove scale located in well equipment, such as the production string and valves, becomes ineffective when the well reaches a certain thermo-hydraulic production profile. Initially with gas/water ratios greater than 100,000, it is believed that halite is formed above the height of the GLV (Gas-Lift Valve). With depletion of the well, the production profile may have led to carbonate and sulfate incrustations in several portions of the well string. The SPU thus began washing using industrial water through bullheading procedures (injection of treatment fluid) with similar efficacy as that of acidification, but without the cost of the vessel. However, the same problem occurs, the well reaches a certain condition of thermo-hydraulic profile in which washings become very frequent, thus leading to loss of production due to frequent stops.

Document PI05135869B1 reveals a method focused on oil recovery through the use of desalinated water through seawater osmosis with heavy emphasis on the seawater desalination method. More specifically, it uses water injection as a secondary oil recovery method, with two objectives: the first objective being to displace the oil within the reservoir from the injection well to the producing well in order to improve the recovery factor of oil from this reservoir, and the second objective being to maintain reservoir pressure by repressurizing the reservoir with seawater.

Document PI08171882A2 proposes a method to control hydrates in a subsea production system, seeking to prevent the problem of obstruction of the production lines due to hydrate formation, which is the result of the combination of petroleum gas with water under certain conditions of temperature and pressure, that is, low temperature (above 300 m water depth and high pressure).

Document BR1020150138334A2 describes processes for removing scale from subsea equipment. In this specific case the equipment is the BCSS pump that operates when it is connected to the production string, with the objective of raising oil production by pumping to the surface, thus creating localized thermodynamic conditions that accelerate the formation and fixation process of the scale both inside the pump and in the string, leading to loss of production.

The document by QUEIROZ, A. C. C.; SILVA, S. J. P., "The influence of scale squeeze acid stimulation treatments (injection of fluids into wells for the chemical treatment of scale) on the productivity index of producing wells, "Final Project (Bachelor's Degree in Petroleum Engineering), 98f., Universidade Federal Fluminense, Niterói, R J, 2017 is a study on the effectiveness of the combination of acid stimulation and scale squeeze treatments in combating the appearance of scale in oil reservoirs. This study references an industrial process for removing sulfate from sea water using desulfating units to prevent the formation of scale with salts derived from sulfate anions with the cations present in the formation water, such as barium, for example, in water that will cross the entire space in the reservoir between the injection well and the production well.

The document by ARIZA, S. F. C., "Application Studies of a New Parameter for Performance Analysis of Oil Production Systems," Master's Dissertation, University of Campinas, SP, 2011 reveals a method for applying the Flow Performance Index (FPI), through case studies of wells that operate with continuous gas lift, and demonstration of the potential application of FPI. More specifically, it reveals types of problems faced in obtaining the gross product in oil wells, specifying the problems of scale and hydrates formed in the production flows, and it presents some cases and solutions on the problems caused by hydrate and scale.

The document by COSTA, A. K. M., "Analysis on production water for disposal and reinjection purposes," Final Project (Bachelor's Degree in Petroleum Engineering), 70f., Fluminense Federal University, Niterói, R J, 2017 is a study that is a theoretical approach to the two routes that produced water can follow, presenting practices used in Brazil that seek to reduce environmental impacts, as well as the practice of reinjecting produced water, taking into account the parameters that this water needs to be inserted. In addition, their possible previous treatments are also presented.

However, no document in the State of the Art reveals a method for preventing saline scale in low-activity aqueous phase reservoir wells by altering formation water saturation and incorporating a scale inhibitor as this invention does.

The method of this invention seeks to increase the water saturation of the reservoir by injecting industrial water into the well via SPU, thus diluting the concentration of salts, such as halite (sodium chloride). When the oil passes through the gas lift mandrel, this dilution will allow a part of the BSW water to evaporate; however, the amount of water that remains in the oil will be sufficient to keep the salts in solution, thus scale formation will not occur and therefore the loss of production will not occur. This solution of the invention reduces the frequency of treatments, thus avoiding loss of production due to well stoppage.

Regarding the incorporation of scale inhibitor in industrial water, it will be injected into the reservoir to increase water saturation, taking advantage of the injection of this water to jointly inject a scale inhibitor, which is soluble in industrial water, thus further inhibiting scale formation in the reservoir and in the well's production string, through the dosage of this inhibitor in industrial water. Scale inhibitors can be selected from the chemical groups of phosphonates, sulfonates and carboxylic acids.

The technical advantages of the invention are increased reliability for SPU with deficiency or failure in subsea injection, increased NPV due to reduced oil loss, and if there is equipment available or provision of industrial water by SPU, remote autonomous treatments can be performed with lower operating costs and increased safety as a function of reduced operations with participation of the stimulation vessel.

BRIEF DESCRIPTION OF THE INVENTION

This invention is in relation to a method focused on increasing the water saturation of the reservoir only in the near well; that is, in the radial area around the well inside the reservoir, which will be delimited by the volume of water that will be injected into the reservoir, in order to increase the BSW of the oil produced to compensate for the dehydration of the BSW of the oil produced. This prevents the output of solution salts followed by the formation of scale in the string. This mitigates the loss of production due to incrustation formed in the production string of the oil-producing well in a gas lift injection scenario, by the association of low BSW with the dehydration caused by dry gas.

One of this invention's objectives is for use in managing production losses due to incrustation, thus improving long-term squeeze techniques due to the difficulty of operating subsea chemical injection systems.

BRIEF DESCRIPTION OF DRAWINGS

This invention will be described in more detail below, with reference to the attached figures which, schematically and with unlimited inventive scope, present examples of its realization. The drawings are as follows.

DETAILED DESCRIPTION OF THE INVENTION

Figure 1:
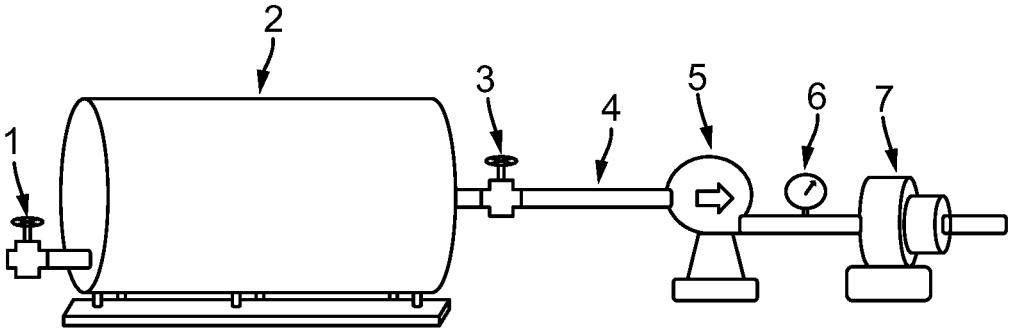
FIG. 1 illustrates the diagram of the tank, inlet valve, outlet valve, rigid or flexible line, pump, pressure gauge, and process fluid flowmeter.
Figure 2:
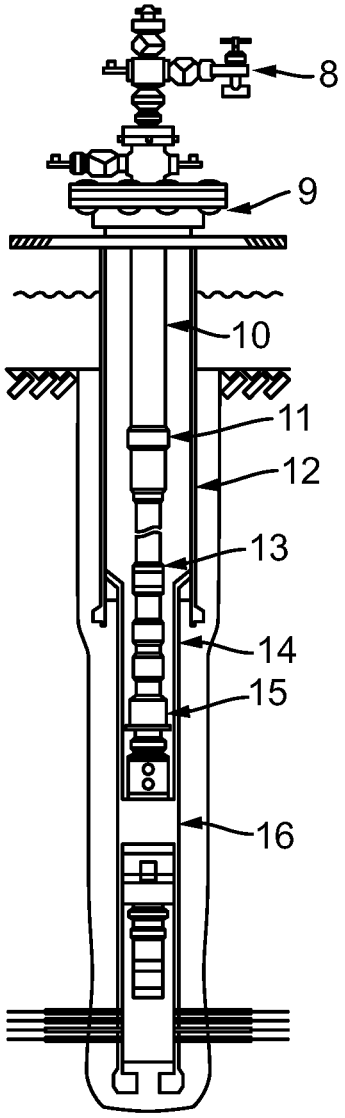
FIG. 2 illustrates a diagram of the production string of an oil well (PS) with the PS components such as a double shear-out, Packer, TSR, gas lift chucks, DHSV, with emphasis on the gas lift chuck.
Figure 3:
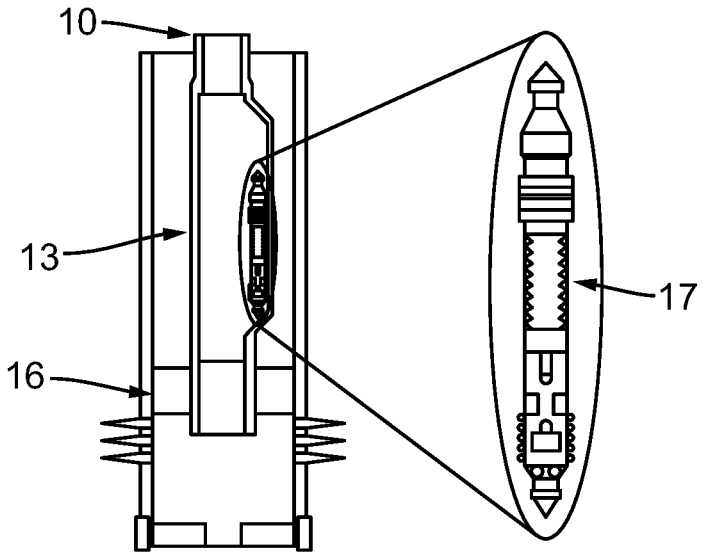
FIG. 3 illustrates a diagram highlighting the gas lift valve, which allows gas to pass from the well annulus to the string to lift the oil, which is positioned inside the gas lift mandrel, positioned in the production string from a well.
Figure 4:
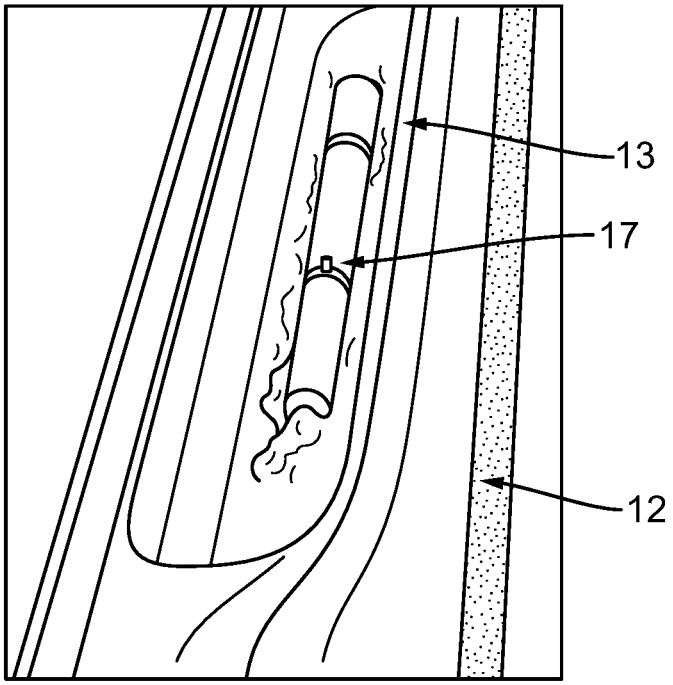
FIG. 4 illustrates a diagram of a gas lift mandrel inside a production string, which in turn is inside a production liner. One can see the gas passing from the gas lift mandrel, the annular between the liner and the production string, through the gas lift valve, into the production string, and exiting at the bottom of the mandrel, which thus lifting the oil.

The method for preventing salt scale according to this invention and illustrated in FIG. 1, which shows the injection facilities that are used to pump industrial water, such as an offshore tank located on an SPU, which comprises a tank (2), inlet valve (1), outlet valve (3) rigid or flexible line (4), hydraulic pump for pumping water (5), pressure gauge to measure the pressure inside the lines between the pump (6), and the flowmeter to measure the flow of water being pumped (7).

The procedure for preventing halite scale, which is the purpose of this invention, can be better understood by referring to FIG. 1.

The first step of the procedure of this invention corresponds to the injection of a volume of industrial or desulfated water, and an inhibitor added to this water in the production string, reaching the reservoir. More specifically, the method for preventing saline scale in wells in low-activity water-phase reservoirs comprises the following steps:

a. Align the industrial or desulfated water stream with an offshore tank;
b. Add scale inhibitor to tank containing water;
c. Inject a volume of industrial or desulfated water containing scale inhibitor through the gas lift line, displacing it with diesel oil inside the production string, until it reaches the reservoir.

The volume of injected water is nearly 1.5 times the volume of the production string, followed by the inhibitor cushion, water and diesel cushion for displacement and injection into the formation.

The volume of diesel oil corresponds to 1.5 times the volume of the production string.

EXAMPLES

The following tests were performed and show examples of how this invention can be used.

In simulating potential incrustation, performed by a computer simulator, partial or total loss of the aqueous phase of oil was verified, which in practice occurs in oil production, when oil that is produced passes through the interior of the string in the position in front of the gas lift mandrel, due to the low percentage of water, 1% of BSW present in the oil, and as the injected gas is dry, the gas expands inside the oil and thus causes the oil to dehydrate through the evaporation of water by the injected gas. This water evaporation process produces a relative increase in precipitation potential, even leading to halite deposits inside the production string at the position just above the gas lift mandrel. The first cases were recorded in 2014 in a well that produces for an FPSO. Halite deposits were found inside the string and identified by changing the values of the TPT-P and the temperature, accompanied by the control panel of the SPU production plant. Initially, on Mar. 8, 2018, the arrival temperature was 22.8° C.; TPT-P=45.4 kgf/cm$^2$. The next time, on Apr. 1, 2018, the arrival temperature was 10.6° C.; TPT-P=35.9 kgf/cm$^2$. This variation in temperature and pressure in the TPT-P is indicative of scale formation inside the string that is generating the pressure drop.

The procedures initially used only industrial water and have been optimized to incorporate scale inhibitor, achieving a reasonable spacing of approximately three to four times greater between washing operations. With the incorporation of formation water, a result similar to the squeezes is expected, using only larger amounts of water, within the SPU'S capabilities.

It should be noted that although this invention has been described with respect to the attached drawings, it may undergo modifications and adaptations by those skilled in the art, depending on the specific situation, but provided that it is within the inventive scope defined herein.

The invention claimed is:

1. A method for preventing saline scale in a well of a low-activity, aqueous-phase reservoir, the method comprising:

aligning an industrial or desulfated water stream with an offshore tank;

adding scale inhibitor to the tank, the tank containing water; and injecting a volume of the industrial or desulfated water containing scale inhibitor through a gas lift line, and displacing the volume of the industrial or desulfated water with diesel oil inside a production string, until the volume of the industrial or desulfated water reaches the reservoir.

2. The method of claim 1, wherein the volume of industrial or desulfated water is nearly 1.5 times a volume of the production string.

3. The method of claim 1, wherein a volume of the diesel oil corresponds to 1.5 times a volume of the production string.

4. The method of claim 1, wherein the reservoir comprises a high-temperature and low-BSW production reservoir well.

* * * * *